United States Patent [19]

Mezger et al.

[11] Patent Number: 4,821,964

[45] Date of Patent: Apr. 18, 1989

[54] TWO-MATERIAL ATOMIZING NOZZLE TO PRODUCE A SOLID-CONE JET

[75] Inventors: Sepp Mezger, Eningen; Werner Raissle, Metzingen, both of Fed. Rep. of Germany

[73] Assignee: Lechler GmbH & Co. KG, Fellbach, Fed. Rep. of Germany

[21] Appl. No.: 150,018

[22] Filed: Jan. 29, 1988

[30] Foreign Application Priority Data

Mar. 2, 1987 [DE] Fed. Rep. of Germany ..... 3706694

[51] Int. Cl.[4] ..... B05B 7/04

[52] U.S. Cl. ..... 239/432; 239/434; 239/499; 239/504

[58] Field of Search ..... 239/427, 432, 434, 499, 239/504, 514, 515, 524

[56] References Cited

U.S. PATENT DOCUMENTS

| | | | |
|---|---|---|---|
| 425,246 | 4/1890 | Paget | 239/514 |
| 1,071,381 | 8/1913 | Anthony | 239/432 |
| 2,543,617 | 2/1951 | Wiant | 239/434 |
| 2,914,257 | 11/1959 | Wiant | 239/432 |
| 3,693,886 | 9/1972 | Conrad | 239/432 |
| 4,483,482 | 11/1984 | Junger et al. | 239/434 |
| 4,568,022 | 2/1986 | Scrivnor | 239/524 |
| 4,591,099 | 5/1986 | Emory et al. | 239/427 |
| 4,624,414 | 11/1986 | Ferrazza | 239/504 |
| 4,728,036 | 3/1988 | Bennett et al. | 239/514 |

FOREIGN PATENT DOCUMENTS

| | | | |
|---|---|---|---|
| 139398 | 3/1948 | Australia | 239/499 |
| 162676 | 10/1982 | Japan | 239/432 |

OTHER PUBLICATIONS

PCT-WO85/02132, Inventor: Emory et al., Title: Nozzle for atomized fan-shaped spray, published: May 23, 1985.

*Primary Examiner*—Andres Kashnikow
*Assistant Examiner*—Michael J. Forman
*Attorney, Agent, or Firm*—Shlesinger & Myers

[57] ABSTRACT

A two-material atomizing nozzle to produce a solid cone jet with a jet angle larger than 45° comprises a nozzle unit with a first duct coaxial with the nozzle discharge and receiving a gaseous medium (for instance air) and a liquid medium (for instance water), a second duct orthogonal to the first duct and issuing into it serving to supply the liquid medium. To supply the gaseous medium, the nozzle unit comprises a third duct issuing into the first duct at the level of the second duct and being orthogonal or essentially orthogonal to both. A recoil bottom is provided for the premixed two-material mixture in the first duct and comprises communication apertures to an annular duct coaxial with and preceding the nozzle discharge into which it merges. The nozzle discharge also is in the shape of an annular duct, however its external boundary is flaring. Such a two-material atomizing nozzle is characterized by a large jet angle, by uniform liquid distribution, by large flow cross-sections and by wide freedom from clogging.

11 Claims, 2 Drawing Sheets

TWO-MATERIAL ATOMIZING NOZZLE TO PRODUCE A SOLID-CONE JET

Figure 1:
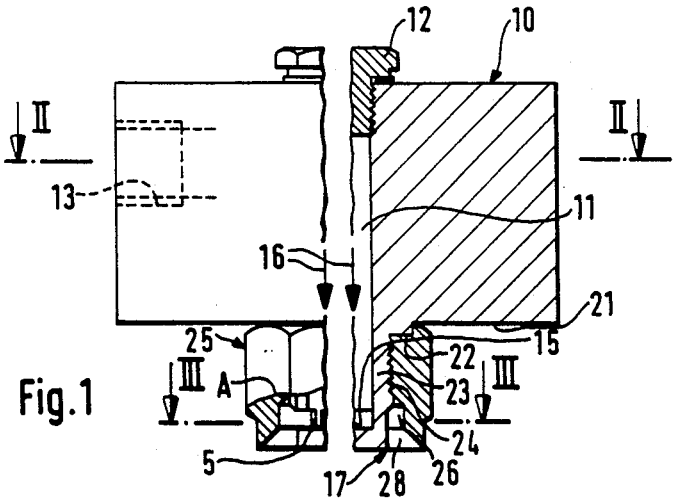

In the cited field of application of continuous casting, the particular cast products must be cooled as uniformly and as intensively as possible. Binary cooling (for instance by means of a mixture of air and water) is superior to an equally conceivable cooling by a pure liquid because the former cools more. As a ruling, cooling of continuous casting is carried out in such a manner that, depending on the width of the particular, cast billet a plurality of nozzles is mounted adjacent to one another and transversely to the direction of advance of the billet. To reduce the number of nozzles otherwise required, nozzles with as large as possible a jet angle (>45°) are desired.

Two-material atomizing nozzles have become known which permit generating a solid cone jet with a large jet angle, however, their jet is not a solid cone, rather it is planar. Illustratively, such a binary atomizing nozzle is disclosed in PCT-A-WO No. 85/02132. However, such planar jets are little suitable for the applications in question, i.e., for continuous casting, because their cooling performance is insufficiently uniform and lacks intensity.

Moreover, a binary atomizing nozzle has become known wherein a solid cone jet is produced on the whole by several nozzle apertures (for instance a central aperture and an annular gap surrounding it) being provided therein. Perforce this design results in excessively small discharge crosssections and thereby in the particular nozzles being susceptible to clogging.

Moreover, a binary atomizing nozzle has become known which is capable per se to generate a kind of solid cone jet with a large jet angle. In this known nozzle, the large jet angle is achieved by a guide cone deflecting the mixture of air and water in the form of a hollow cone. Part of this water is deflected from the cone surface through three bores toward the center. This known design incurs the significant drawback that large drops are produced at the center of the jet because only water, but not air, is deflected. The three bores must be made very small. Thereby the danger of clogging is much raised if the water should be soiled, and in the event of bore clogging, the result shall be merely a hollow cone atomization, which furthermore is undesired.

The object of the invention is to create a two-material atomizing nozzle of the initially cited type and which is characterized by a large jet angle, uniform distribution of the liquid, large flow cross-sections and thereby by very substantial freedom from clogging.

This problem is solved by the invention by the features stated in the characterizing part of the claim 1. Advantageously, the invention makes it possible to generate an actual solid cone jet with jet angles >45°. The liquid distribution of the solid cone can be controlled by the nozzle geometry (even liquid distribution). The nozzle of the invention evinces large flow cross-sections relative to the known nozzles described above and thereby is nearly free from clogging by soiled water.

Further advantageous embodiments of the invention are stated in the dependent claims.

The invention is further explained by means of illustrative embodiments shown in the drawing and described below.

Figure 2:
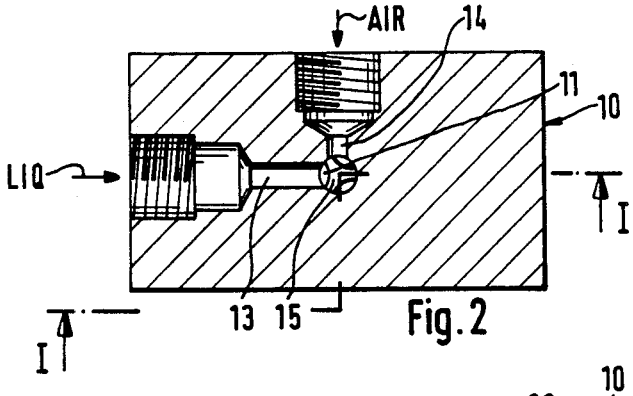
Figure 3:
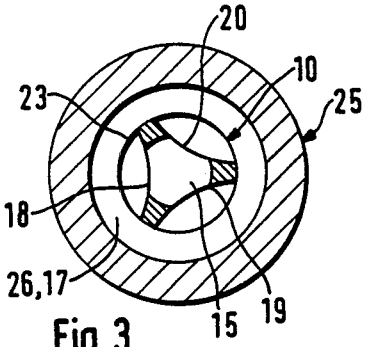
Figure 4:
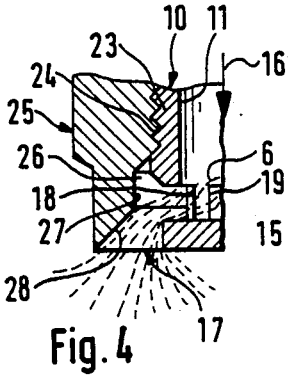
Figure 5:
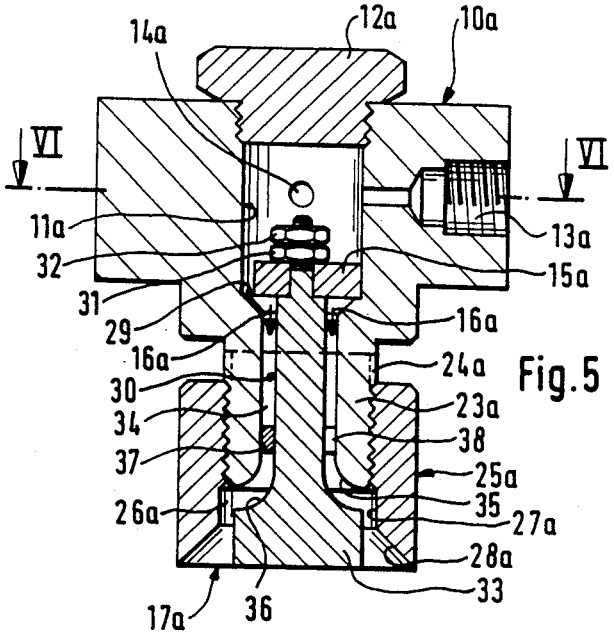
Figure 6:
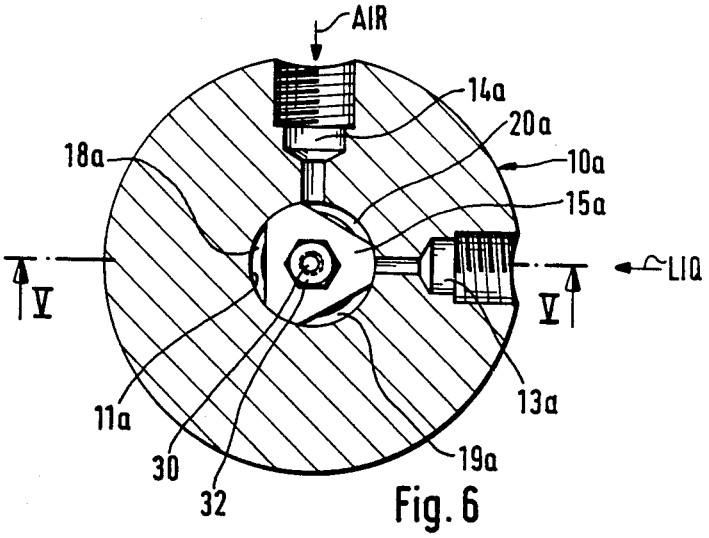

FIG. 1 is an embodiment mode of a two-material atomizing nozzle shown half in elevation and half in longitudinal section (section I—I of FIG. 2), FIG. 2 is the object of FIG. 1 in cross-section (section II—II of FIG. 1), FIG. 3 is a section along line III—III of FIG. 1, on a larger scale than in FIGS. 1 and 2, FIG. 4 is the detail "A" of FIG. 1 shown on a larger scale than in FIG. 1, FIG. 5 is another embodiment mode of a two-material atomizing nozzle shown in vertical longitudinal section (section V—V of FIG. 6), and FIG. 6 is the nozzle of FIG. 5 in cross-section (section VI—VI of FIG. 5).

In FIGS. 1 through 4, the reference numeral 10 denotes a nozzle unit of a two-material atomizing nozzle. The nozzle unit 10 is parallelipipedic and comprises a first duct 11 which is vertical (in FIG. 1) and sealed at its upper end by a screw 12. FIG. 2 shows that two further ducts 13 and 14 enter orthogonally to each other and to the first duct 11 into this duct 11. The duct 13 (hereafter the second duct) supplies a liquid, for instance, water, and the duct 14 (hereafter the third duct) supplies a gas, for instance air.

As shown by FIG. 1 and in particular by the enlargement of FIG. 4, the first duct 11 is a so-called blind hole, that is, it is closed at the lower end shown in FIGS. 1 and 4 by a bottom 15. The bottom 15 acts as a recoil base for the mixture of gas and liquid pre-mixed within the first duct 11 and moving in the direction of the arrow 16 toward the nozzle discharge denoted as a whole by 17. In particular FIGS. 2 and 3 show further three radial millings 18, 19 and 20 tightly above the recoil bottom 15 that allow the gas-liquid mixture to escape from the first duct 11 into the ambient, as indicated in FIG. 4.

FIGS. 1, 3 and 4 moreover show that the nozzle unit 10 comprises a cylindrical reduction 23 offset like a bolt at 21 and 22 and coaxial with the first duct 11. The cylindrical reduction 23 comprises an outer thread 24 on which is screwed an externally hexagonal deflecting cap denoted as a whole by 25. Together with the cylindrical reduction 23 of the nozzle unit 10, the deflecting cap 25 forms on its inside an annular duct 26 and in an axial extension thereto, the already mentioned nozzle discharge 17 also in the shape of an outer duct. The annular duct 26 is connected by radial millings 18, 19, 20—which accordingly act as communication apertures—with the first duct 11 in such a manner that the gas-liquid mixture can pass from the first duct 11 through the communication apertures 18 through 20 into the annular duct 26 and from there through the nozzle discharge 17 into the ambient. Whereas the annular duct 26 is bounded externally by a cylindrical surface 27, the nozzle discharge 17 in the shape of an annular gap flares in the direction of flow 16 and for that purpose, its outer boundary is a conical surface 28 (FIGS. 1, 4).

The two-material atomizing nozzle described above operates as follows. Due to the supply of water through the second duct 13 and of air thruugh the third duct 14 into the first duct 11, the two media being supplied at mutually orthogonal directions will thereby be mixed in the first duct 11. The mixture of air and water flows along the first duct 11 in the direction of the arrow 16 until impacting the recoil bottom 15. Shown by the embodiment of FIGS. 1 through 4, the recoil bottom 15 is an even surface. However, depending on the liquid distribution desired, it may be also recessed in spherical or conical manner. At the recoil bottom 15, the mixture is radially deflected outward, and as indicated in FIG. 4, it passes through the millings 18, 19, 20 acting as communication apertures into the cylindrical annular duct 26 and simultaneously or subsequently into the conical-/annular ring gap which is the nozzle discharge 17, from where it is emitted as a finely atomized solid cone jet into the ambient. Because the repeated deflection at the recoil bottom 15 and within the deflection cap 25, the mixture of air and water that had been premixed, heretofore in the first duct 11 now has been mixed completely, i.e. for the last time, and the desired solid cone jet is made possible thereby.

For the sake of clarity, the components shown in FIGS. 5 and 6 that correspond to the embodiment of the FIGS. 1 through 4 have been provided with the same reference numerals, though supplemented by the letter a to distinguish them from those of FIGS. 1 through 4.

Contrary to the embodiment mode of FIGS. 1 through 4, FIGS. 5 and 6 show the first duct 11*a* as a through-bore and the recoil bottom 36 being formed by a stud 30 mounted as a separate component in the nozzle unit 10*a*. The stud 30 is fixed in place by a fastener 15*a* mounted on an offset 29 of the first duct 11*a*. Two nuts 31, 32 are used for locking. As further shown by FIG. 5, the stud 30 flares into a disk at its end 33 on the nozzle discharge side and there forms the recoil bottom 36 which accordingly evinces a radius generated surface.

However, as an alternative to the embodiment of the recoil bottom 36 shown in FIG. 5, it is conceivable furthermore to make its surface even and at right angle to the longitudinal nozzle axis (approximately in the manner of FIGS. 1 through 4). Again, an oblique/conical design of the surface of the recoil bottom 36 is possible.

Again, alternative designs of the recoil bottom of the embodiment mode of FIGS. 1 through 4 are conceivable.

Similarly to the design of FIGS. 1 through 4, the external boundary of annular duct 26*a* and nozzle discharge 17*a* is formed by corresponding inner walls 27*a* and 28*a* resp. of a deflection cap 25*a* screwed onto a thread 24*a* of a peg-shaped offset reduction 23*a* of the nozzle unit 10*a* in the variation of FIGS. 5, 6.

A further trait of the two-material atomizing nozzle shown in FIGS. 5 and 6 is that the stud 30 is of a lesser diameter above its disk-like flaring part than the first duct 11*a* and that thereby an annular gap 34 is subtended between the stud 30 and the wall of the first duct 11*a* to act as a communication aperture between the fastening component 15*a* and the annular duct 26*a* or the nozzle discharge 17*a*. At the lower end of the peg-like offset reduction 23*a*, the first duct 11*a* merges into a rounded flare 35 corresponding to the rounded part of the recoil bottom 36. In its position shown in FIG. 5 within the nozzle unit 10*a*, the stud 30 is fixed in place by a spacer schematically indicated in FIG. 5 and denoted by 37, which is provided with axial passageways 38 for the air-liquid mixture flowing in the direction of the arrow 16*a*.

The two-material atomizing nozzle of FIGS. 5 and 6 evinces a further characteristic over the embodiment of FIGS. 1 through 4 that shall now be discussed. The fastening component 15a when seen in top view or cross-section is an equilateral triangle with apices rounded off in relation to the radius of the first duct 11a against which they rest. Arcuate and secant-like clearances denoted by 18*a*, 19*a* and 20*a* in FIG. 6 are the communication apertures of the air-water mixture from the fastening part 15*a* to the annular gap 34 and hence also to the annular duct 26*a* and the nozzle discharge 17*a*, these clearances being located beween the sides of the "triangle" of the fastener 15*a* and the wall of the first duct 11*a*.

Regarding its operation, the two-material atomizing nozzle of FIGS. 5 and 6 essentially corresponds to the operation of the embodiment of FIGS. 1 through 4 and repeated discussion therefore is unnecessary. Instead it must be pointed out that both the embodiments of FIGS. 1 through 4 and FIGS. 5 and 6 evince another feature. This characteristic is that the deflecting cap 25 or 26 is continuously adjustable on account of its being threaded on the cylindrical reduction 23 or 23*a* of 10 or 10*a* relative to latter in the axial direction. As a result, the jet angle of the solid cone jet issuing from nozzle can be continuously adjusted from about 45° to about 120°.

Alternatively to the shown screw-fastening of the deflecting cap 25, 25*a* on the nozzle unit 10, 10*a*, this deflecting cap 25, 25*a* also might be fastened by a snap-in means that would be provided at specific axial spacings on the nozzle unit 10, 10*a* or at its cylindrical reduction 23, 23*a*. In this manner, adjustment in steps of the deflecting cap 25, 25*a* would be possible relative to the nozzle unit 10, 10*a* and thereby the solid cone jet angle also would be adjustable stepwise.

We claim:

1. A binary atomizing nozzle, comprising:

(a) a housing;

(b) said housing having a passageway having an upper portion and a lower portion and a longitudinal axis;

(c) a gas inlet and a liquid inlet connected to said housing and opening into said passageway upper portion for mixing said gas and liquid;

(d) said lower portion of said passageway having mounted thereon a movable outer sleeve surrounding said passageway lower portion and having a retracted and an extended position relative to said housing;

(e) said passageway including at said lower portion a mixture impinging member at the bottom of said passageway and having means for projecting said mixture radially outwardly and generally transversely to said passageway longitudinal axis and beyond said impinging member and said projecting means;

(f) said outer sleeve including a cylindrical annular inside wall having an upper and lower end, spaced outwardly from said impinging member and said projecting means a substantial distance and extending parallel to said longitudinal axis;

(g) said outer sleeve including a frusto-conical annular inside wall connected to said lower end of said cylindrical annular inside wall and flaring outwardly and downwardly from said cylindrical annular inside wall and having a bottom edge;

(h) said impinging member having a bottom outer surface and a cylindrical annular wall extending upwardly from said bottom surface;

(i) said frusto-conical annular wall being spaced outwardly and radially from said cylindrical annular wall of said impinging member; and (j) said impinging member being fixed and said outer sleeve being movable longitudinally with respect to said passageway a substantial distance downwardly from said bottom surface of said impinging member so as to extend below said bottom surface when in its greatest extended position and having its bottom edge substantially even with said bottom surface of said impinging member when in its uppermost retracted position.

2. A binary atomizing nozzle, as in claim 1, wherein:

(a) said gas inlet and said liquid inlet are orthogonal to each other.

3. A binary atomizing nozzle, as in claim 2, wherein:

(a) said gas inlet and said liquid inlet are orthogonal to said longitudinal axis of said passageway in said housing.

4. A binary atomizing nozzle, as in claim 3, wherein:

(a) said mixture impinging member includes an inner horizontal surface orthogonal to said longitudinal axis of said passageway.

5. A binary atomizing nozzle, as in claim 4, wherein:

(a) said projecting means includes a plurality of apertures disposed above said horizontal inner surface of said mixture impinging member.

6. A binary atomizing nozzle, as in claim 5, wherein:

(a) said outer sleeve includes an inner thread and said lower portion of said housing includes an outer thread which cooperates with said inner thread.

7. A binary atomizing nozzle, as in claim 1, wherein:

(a) said impinging member is formed from a stud having a rod portion and an enlarged end portion, said rod portion having a smaller cross-section than said passageway;

(b) said rod portion extends part way into said passageway, thereby forming an annular channel therebetween and is secured therein;

(c) said enlarged end portion is associated with said passageway lower portion and includes said bottom outer surface and said cylindrical annular wall of said impinging member; and (d) said stud includes a transition surface between said rod portion and said enlarged end portion, said transition surface extends downwardly and outwardly and connects with an upper portion of said cylindrical annular wall of said impinging member.

8. A binary atomizing nozzle, as in claim 7, wherein:

(a) said passageway lower portion includes a bottom edge surface spaced from said transition surface and extends downwardly and radially outwardly toward said cylindrical annular inside wall of said outer sleeve.

9. A binary atomizing nozzle, as in claim 8, wherein:

(a) said rod portion of said stud is secured to a plate; and (b) said passageway includes an offset operably associated with said plate.

10. A binary atomizing nozzle, as in claim 9, wherein:

(a) said plate is disposed within said passageway downwstream of said air and liquid inlet; and (b) said plate includes cut-outs for permitting flow of said gas and liquid through said plate.

11. A binary atomizing nozzle, as in claim 10, wherein:

(a) said passageway has a circular cross-section; and (b) said plate is substantially triangular in shape and includes rounded corners corresponding with said passageway circular cross-section.

* * * * *